US005699814A

United States Patent [19]

Potut

[11] Patent Number: 5,699,814

[45] Date of Patent: Dec. 23, 1997

[54] CURVED TOOTHED HAIRCLIP

[75] Inventor: Christian Potut, Arbent, France

[73] Assignee: C.S.P. Diffusion, société anonyme, Arbent, France

[21] Appl. No.: 612,325

[22] Filed: Mar. 7, 1996

[30] Foreign Application Priority Data

Sep. 21, 1995 [FR] France ..... 95 11245

[51] Int. Cl.[6] ..... A45D 8/20

[52] U.S. Cl. ..... 132/277; 132/276; 132/273; 132/279

[58] Field of Search ..... 132/277, 278, 132/279, 273, 275, 138, 132, 133, 161; D28/32, 39, 40, 41

[56] References Cited

U.S. PATENT DOCUMENTS

| | | | |
|---|---|---|---|
| 717,499 | 12/1902 | Gouy | 132/133 |
| 918,203 | 4/1909 | Schwarzer | 132/133 |
| 1,528,643 | 3/1925 | Walter . | |
| 2,902,042 | 9/1959 | Halber | 132/133 |
| 3,998,233 | 12/1976 | Dorr . | |
| 5,494,060 | 2/1996 | Potut | 132/279 |
| 5,520,201 | 5/1996 | Hart et al. | 132/277 |
| 5,549,127 | 8/1996 | Chang | 132/279 |

FOREIGN PATENT DOCUMENTS

| | | | |
|---|---|---|---|
| 395897 | 5/1909 | France | 132/133 |
| 592049 | 7/1925 | France . | |
| 1175947 | 4/1959 | France . | |
| 648901 | 7/1937 | Germany . | |
| 8703873 | 10/1987 | Germany . | |

*Primary Examiner*—Gene Mancene
*Assistant Examiner*—Pedro Philogene
*Attorney, Agent, or Firm*—William H. Eilberg

[57] ABSTRACT

A curved toothed hairclip comprises two elongate branches hinged together at their first ends about a transverse hinge axis and separably fastenable together at their second ends. Each branch has curved teeth extending laterally from the first lateral edge, curving towards the other branch and interdigitated with the curved teeth of the other branch. This improves the retention of the hair in the hairclip.

10 Claims, 2 Drawing Sheets

CURVED TOOTHED HAIRCLIP

BACKGROUND OF THE INVENTION

1. Field of the Invention

The present invention concerns hairclips used to hold the hair in a particular style.

2. Description of the Prior Art

Hairclips have been used for many years. Document U.S. Pat. No. 1,528,643, for example, describes a hairclip of this kind having first and second elongate branches with respective mutually facing inside faces, respective outside faces and respective lateral edges. The first and second branches are hinged together at their first ends about a hinge axis enabling them to pivot between a close together position in which they are generally parallel to each other and a spaced apart position. The first and second branches can be separably fastened together at their second ends in the close together position, in which they can grip a lock of hair between their respective faces. In the above document the first and second elongate branches are generally flat, rectilinear and smooth, with parallel lateral edges, and the transverse hinge axis is in the plane of the branches.

In document FR-A-1 175 947, one of the branches has on its inside face teeth adapted to engage in the hair. The teeth are necessarily short, to enable the respective inside faces to come close to each other in the close together position.

With these prior art hairclips the lock of hair would seem to be satisfactorily gripped when the intention is to hold the hair tangentially to the surface of the head.

Sometimes, however, the hairclip is used to hold a lock of hair radially away from the surface of the head. In this case the hairclip must be relatively narrow, failing which the weight of the hair tends to cause the lock of hair to slip in the hairclip, with the result that the grip is insufficient.

The problem to which the present invention is addressed is thus that of designing a new hairclip structure providing a better grip on the hair, so that a greater amount of hair can be held, at a greater radial distance from the surface of the head.

In accordance with the invention, the hairclip is also given an auxiliary combing function, enabling the hair to be styled when it is fitted.

SUMMARY OF THE INVENTION

To achieve these and other objects, the invention consists in a hairclip having first and second elongate branches with respective inside faces facing each other, respective outside faces and respective first and second lateral edges, the first and second branches being hinged together at their first ends about a hinge axis enabling them to pivot between a close together position in which they are generally parallel to each other and a spaced apart position, the first and second branches being adapted to be separably fastened together at their second ends in the close together position in which they can grip a lock of hair between their respective inside faces, wherein each of the first and second branches has curved teeth extending laterally from the first lateral edge and curving towards the other of the first and second branches, being interdigitated with the curved teeth of said other branch so that in the close together position the curved teeth pass through said lock of hair.

In one advantageous embodiment the curved teeth extend tangentially from the corresponding first lateral edge. They can have a circular arc shape longitudinal profile, subtending an angle between 45° and 90°, advantageously about 60°.

The respective second lateral ends are preferably raised away from each other and can have a circular arc shape longitudinal profile.

Other objects, features and advantages of the present invention will emerge from the following description of a specific embodiment given with reference to the appended drawings.

DETAILED DESCRIPTION OF THE PREFERRED EMBODIMENT

Figure 1:
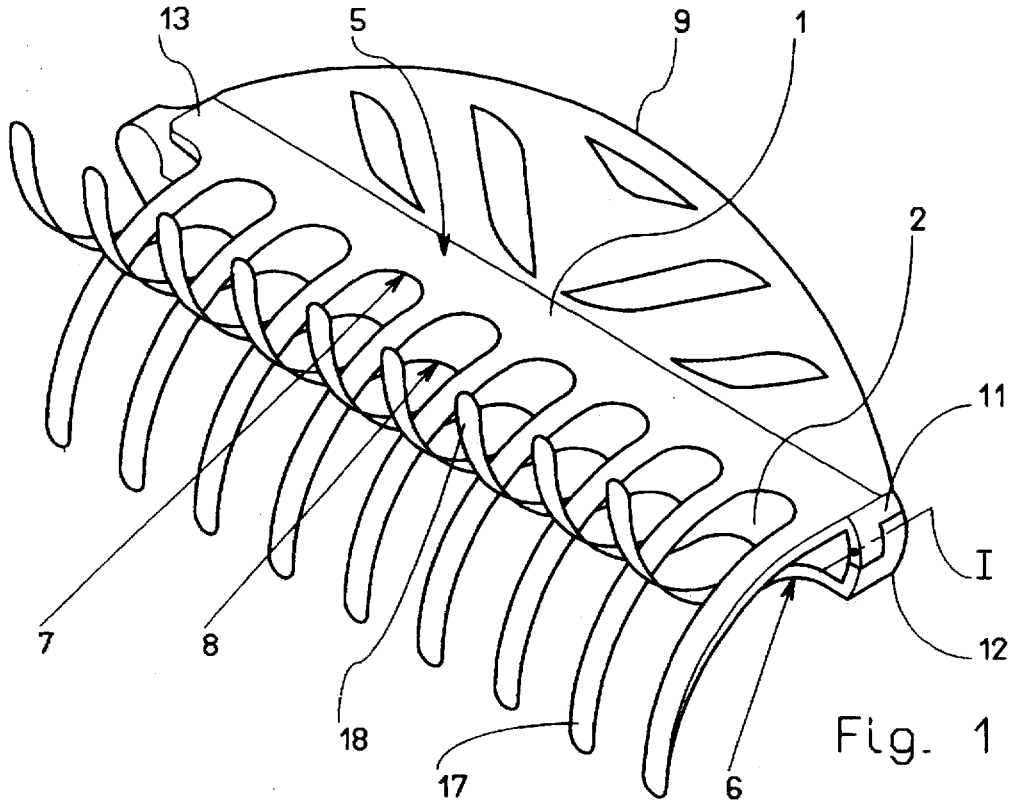
FIG. 1 is a perspective view of one embodiment of a hairclip in accordance with the present invention, seen from the side with the curved teeth.
Figure 2:
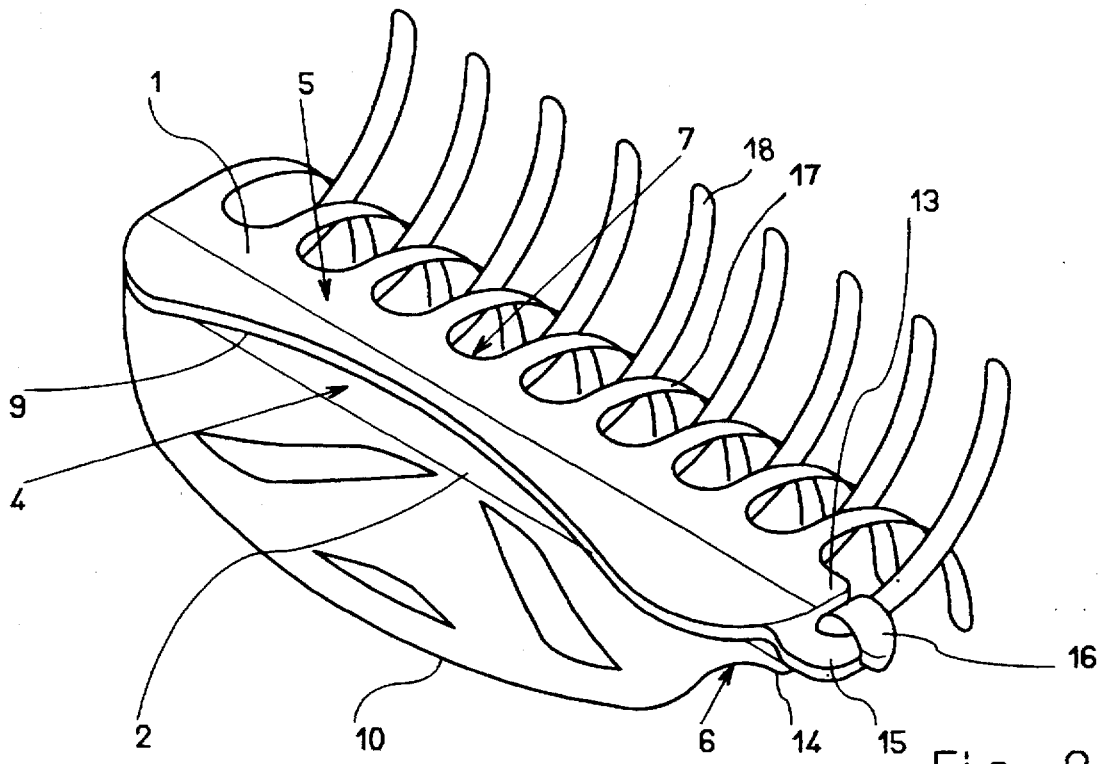
FIG. 2 is a perspective view of the hairclip from FIG. 1, seen from the opposite side.

In the embodiment of the invention shown in the figures, the hairclip of the invention comprises a first branch 1 and a second branch 2, both elongate in shape and having respective inside faces 3 and 4 facing each other, respective outside faces 5 and 6, respective first lateral edges 7 and 8 and respective second lateral edges 9 and 10.

Figure 5:
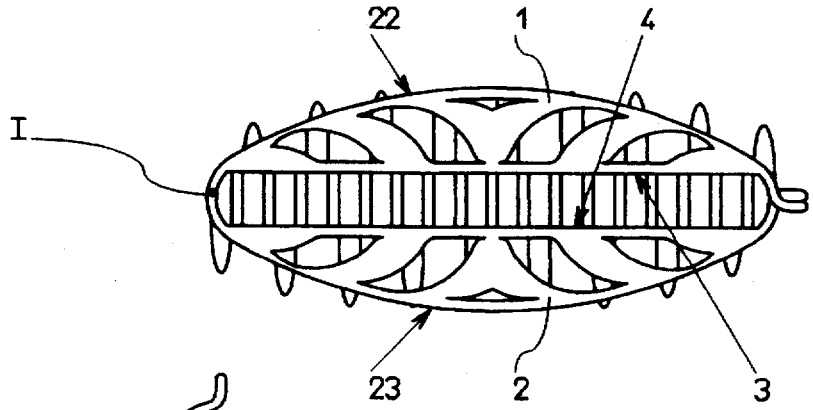
FIG. 5 is a front view of the hairclip from FIG. 1, from the side opposite the curved teeth, in the close together position.
Figure 6:
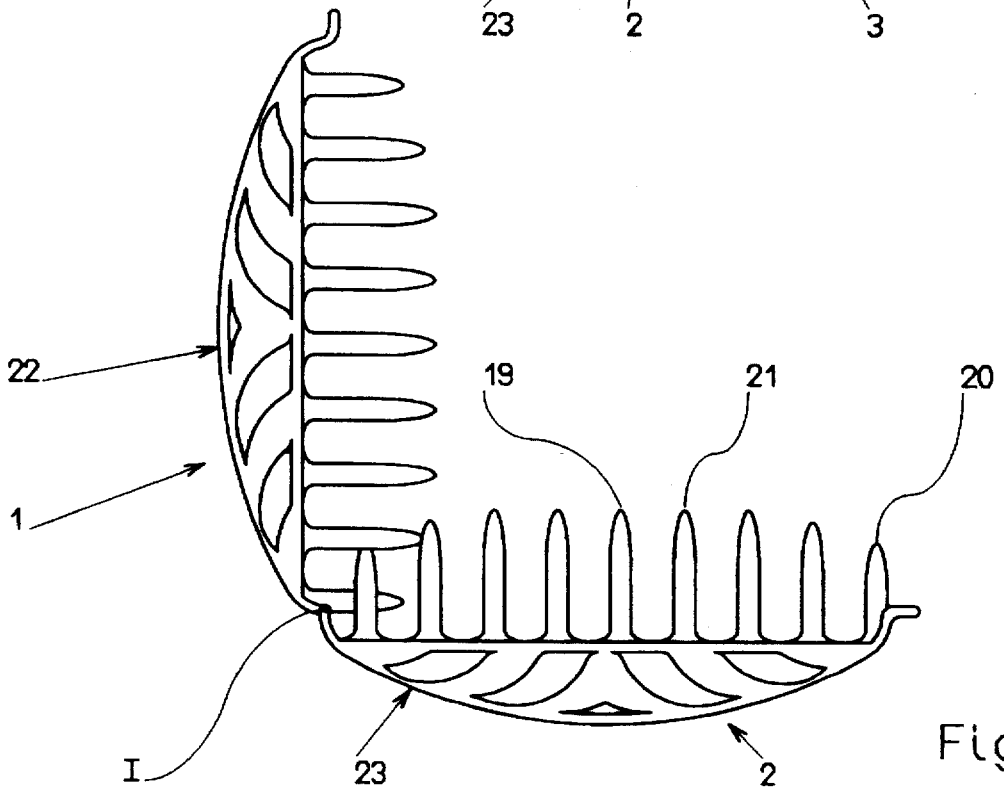
FIG. 6 is a front view of the hairclip from FIG. 1, from the side opposite the curved teeth, in a position opened through 90°.

The first branch 1 and the second branch 2 are hinged together at their respective first ends 11 and 12 by a hinge enabling them to pivot between a close together position shown in FIG. 5 and a spaced apart position shown in FIG. 6, for example. Note that in FIG. 6 the branches 1 and 2 are at 90° to each other, although their angular separation can have a different value, for example 180°, the hinge offering no opposition to this pivoting. The branches can be hinged together by a hinge type transverse articulation axis I, as shown in the figures, for example.

In the close together position shown in FIG. 5, the branches 1 and 2 are generally parallel to each other, their respective inside faces 3 and 4 being relatively close together to grip a lock of hair between them.

At their second ends 13 and 14 the branches 1 and 2 can be separably fastened together in the close together position. For example, and as shown in the figures, ends 13 and 14 may be provided having hook-shape lugs 15 and 16 adapted to engage one behind the other by virtue of elastic deformation.

The first branch 1 incorporates curved teeth, e.g. the tooth 17, extending laterally from the first lateral edge 7 and curving towards the second branch 2. Similarly, the second branch 2 incorporates curved teeth, e.g. the tooth 18, extending laterally from the first lateral edge 8 and curving towards the first branch 1. The curved teeth 17 of the first branch 1 are interdigitated with the curved teeth 18 of the second branch 2 in the close together position. Accordingly, in the close together position, the curved teeth 17 and 18 pass through the lock of hair held by the hairclip.

Figure 3:
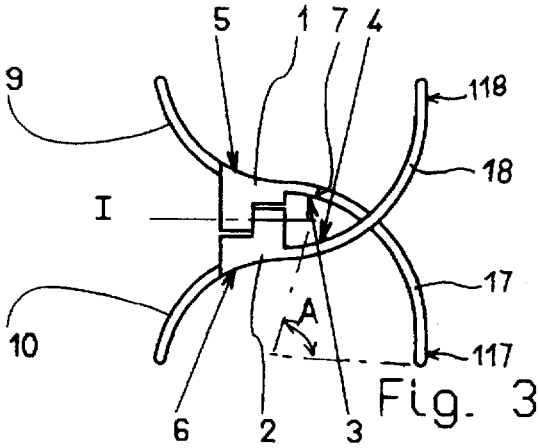
FIG. 3 is an end view of the hairclip from FIG. 1, seen from the hinged side.
Figure 4:
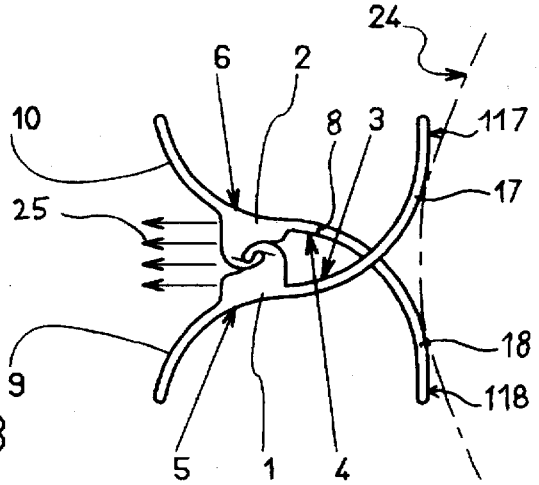
FIG. 4 is an end view of the hairclip from FIG. 1 seen from the second ends adapted to be fastened together.

In the embodiment shown, as seen more clearly in FIGS. 3 through 5, the curved teeth 17 of the first branch 1 are substantially parallel to each other and extend tangentially from the corresponding first lateral edge 7. Similarly, the curved teeth 18 of the second branch 2 are substantially parallel to each other and extend tangentially from the corresponding first lateral edge 8. The curved teeth 17 and 18 each have an arc shape longitudinal profile in a respective plane that can be substantially perpendicular to the longitudinal direction of the branches 1 and 2. In an advantageous alternative embodiment, not shown, the respective planes of the teeth of a series of curved teeth 17 or 18 can be slightly divergent, whilst remaining generally parallel to the transverse hinge axis I, which facilitates crossing over of the curved teeth 17 and 18 without contact or excessive friction and which enables better penetration of the hair.

The arc shape of the curved teeth 17 and 18 subtends an angle A in its respective plane between approximately 45° and 90°, advantageously around 60°. The free end portions 117 and 118 of the curved teeth 17 and 18 can with advantage be substantially coplanar. The expression "arc" as used herein may refer to a circular arc, an elliptical arc or more generally any arc of any regular or irregular curve. The figures show an embodiment in which the curved teeth are circular arc shape.

As seen in FIGS. 5 and 6, the center teeth, e.g. the tooth 19, can advantageously be longer than the end teeth, e.g. the tooth 20.

The separation between the teeth, i.e. the separation between the respective planes of two successive teeth, e.g. 19 and 21, is chosen to allow the branches 1 and 2 to pivot about the transverse hinge axis I.

In the embodiment shown in the figures, the respective second lateral edges 9 and 10 are raised away from each other. For example they are curved with a circular arc shape transverse profile seen more clearly in FIGS. 3 and 4.

The second lateral edges 9 and 10 can advantageously have a circular arc shape longitudinal profile 22 or 23 seen more clearly in FIGS. 5 and 6.

It will be realized that the shape of the curved teeth makes the hairclip an effective comb and, more importantly, confers upon it excellent hair retaining properties enabling the production of cascade type hairstyles. In a hairstyle of this kind, the ends of the teeth bear against the surface 24 of the head shown in FIG. 4, and the lock of hair departs radially from the surface 24 of the head, passing through the hairclip between the branches 1 and 2 which grip it, as shown by the arrows 25. The presence of the curved teeth enables the branches 1 and 2 to be made wider, without risk of the hair slipping in the hairclip in the close together position.

The present invention is not limited to the embodiments specifically described, but encompasses variants and generalizations thereof within the scope of the following claims.

There is claimed:

1. Hairclip having first and second elongate branches with respective first and second inside faces facing each other, respective outside faces and respective first and second lateral edges, the first and second branches being hinged together at their first ends about a hinge axis enabling the first and second branches to pivot between a close together position in which the first and second inside faces are generally parallel to each other and a spaced apart position in which the first and second inside faces are angularly offset from each other, the first and second branches being adapted to be separably fastened together at their second ends in the close together position in which the first and second branches can grip a lock of hair between their respective inside faces, wherein each of the first and second branches has curved teeth extending laterally from the first lateral edge and curving towards the other of the first and second branches, the curved teeth of each of the first and second branches being interdigitated with the curved teeth of another of the first and second branches so that in the close together position the curved teeth pass through said lock of hair.

2. Hairclip according to claim 1 wherein said curved teeth extend tangentially from the corresponding first lateral edge.

3. Hairclip according to claim 1 wherein said curved teeth have an arc shape longitudinal profile.

4. Hairclip according to claim 3 wherein the arc shape of said curved teeth subtends in its respective plane an angle between about 45° and 90°, advantageously about 60°.

5. Hairclip according to claim 1 wherein at least one of the first and second branches has center teeth and end teeth, and wherein the center teeth are longer than the end teeth.

6. Hairclip according to claim 1 wherein there is a separation between said curved teeth, and wherein the separation between said curved teeth allows said branches to pivot about a transverse hinge axis.

7. Hairclip according to claim 1 wherein the respective second lateral edges are raised away from each other.

8. Hairclip according to claim 7 wherein the respective second lateral edges are curved with a circular arc shape transverse profile.

9. Hairclip according to claim 7 wherein the respective second lateral edges have a circular arc shape longitudinal profile.

10. Hairclip according to claim 1 wherein said curved teeth have free end portions, and wherein the free end portions of said curved teeth are substantially coplanar.

* * * * *